US005908360A

United States Patent [19]

Guillont

[11] Patent Number: 5,908,360

[45] Date of Patent: Jun. 1, 1999

[54] ENTERTAINMENT AND EXERCISE GAME

[76] Inventor: Mario Guillont, 6214 Goodland Ave., North Hollywood, Calif. 91606

[21] Appl. No.: 08/970,008

[22] Filed: Nov. 13, 1997

[51] Int. Cl.[6] ..... A63B 71/02

[52] U.S. Cl. ..... 473/416; 473/465; 473/447

[58] Field of Search ..... 473/92, 473, 470, 473/446, 416, 471, 595, 596, 597, 468, 474; 405/71; 49/274; 273/400

[56] References Cited

U.S. PATENT DOCUMENTS

| | | | |
|---|---|---|---|
| D. 222,978 | 2/1972 | Gustavo | 273/400 |
| 2,886,323 | 5/1959 | Irwin | 473/596 |
| 3,580,578 | 5/1971 | McCarthy | 473/471 |
| 3,865,371 | 2/1975 | Theriot | 473/465 |
| 4,492,380 | 1/1985 | Saytar | 273/400 |
| 4,940,232 | 7/1990 | Chen | 273/400 |
| 5,067,730 | 11/1991 | Wanalista | 473/468 |
| 5,238,243 | 8/1993 | Grispi | 473/446 |
| 5,395,122 | 3/1995 | Kraemer | 473/400 |
| 5,722,907 | 3/1998 | Paulum | 473/465 |
| 5,735,776 | 4/1998 | Swezey | 473/596 |

*Primary Examiner*—Theatrice Brown

[57] ABSTRACT

A game is provided including a playing field. A pair of planar vertically oriented backboards are situated at opposite ends of the playing field with a plurality of apertures formed therein and a net mounted within each aperture. A ball is provided having a circular configuration and formed of an elastomeric material. The ball has a pair of flexible resilient wings mounted on diametrically opposed sides thereof. A plurality of game units include a racquet and a lacrosse stick.

9 Claims, 2 Drawing Sheets

ENTERTAINMENT AND EXERCISE GAME

BACKGROUND OF THE INVENTION

1. Field of the Invention

The present invention relates to games and more particularly pertains to a new game for providing entertainment and exercise.

2. Description of the Prior Art

The use of games is known in the prior art. More specifically, games heretofore devised and utilized are known to consist basically of familiar, expected and obvious structural configurations, notwithstanding the myriad of designs encompassed by the crowded prior art which have been developed for the fulfillment of countless objectives and requirements.

Known prior art games include U.S. Pat. No. 4,998,728; U.S. Pat. No. 5,098,097; U.S. Pat. Des. No. 301,361; U.S. Pat. No. 5,123,645; U.S. Pat. No. 5,183,263; and U.S. Pat. No. 5,224,704.

In these respects, the game according to the present invention substantially departs from the conventional concepts and designs of the prior art, and in so doing provides an apparatus primarily developed for the purpose of providing entertainment and exercise.

SUMMARY OF THE INVENTION

In view of the foregoing disadvantages inherent in the known types of games now present in the prior art, the present invention provides a new game construction wherein the same can be utilized for providing entertainment and exercise.

The general purpose of the present invention, which will be described subsequently in greater detail, is to provide a new game apparatus and method which has many of the advantages of the games mentioned heretofore and many novel features that result in a new game which is not anticipated, rendered obvious, suggested, or even implied by any of the prior art games, either alone or in any combination thereof.

To attain this, the present invention generally comprises a playing field having a generally diamond shaped configuration. As shown in FIG. 1, the game is equipped with a periphery defined by a peripheral vertical wall. For reasons that will soon become apparent, a plurality of circles are situated on the playing field each with a unique playing indicia formed therein. Further provided is a pair of bleachers each having a generally V-shaped configuration. The bleachers each line a corresponding side of the playing field. FIG. 1 shows a pair of planar vertically oriented backboards situated at opposite ends of the playing field and each having an inverted trapezoidal configuration. A plurality of apertures are formed in the backboard. Further, a net is mounted within each aperture. A pair of baskets are mounted on opposite sides of the backboard. Lastly, a front net is coupled to a bottom edge of the backboard and extends forwardly therefrom. It should be noted that the backboards are each adapted to pivot about a vertical axis. A ball is provided having a circular configuration. Such ball is formed of an elastomeric material. The ball has a pair of flexible resilient wings mounted on diametrically opposite sides thereof. Finally, a plurality of game units include a racquet, a lacrosse stick and a thrower. As shown in FIG. 3, the thrower has an elongated handle and a cylindrical tube mounted to an end of the handle in perpendicular relationship therewith. The thrower is adapted for allowing a user to place the ball within the tube such that the same may be thrown.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new game apparatus and method which has many of the advantages of the games mentioned heretofore and many novel features that result in a new game which is not anticipated, rendered obvious, suggested, or even implied by any of the prior art games, either alone or in any combination thereof.

It is another object of the present invention to provide a new game which may be easily and efficiently manufactured and marketed.

It is a further object of the present invention to provide a new game which is of a durable and reliable construction.

An even further object of the present invention is to provide a new game which is susceptible of a low cost of manufacture with regard to both materials and labor, and which accordingly is then susceptible of low prices of sale to the consuming public, thereby making such game economically available to the buying public.

Still yet another object of the present invention is to provide a new game which provides in the apparatuses and methods of the prior art some of the advantages thereof, while simultaneously overcoming some of the disadvantages normally associated therewith.

Still another object of the present invention is to provide a new game for providing entertainment and exercise.

Even still another object of the present invention is to provide a new game that includes a playing field. A pair of planar vertically oriented backboards are situated at opposite ends of the playing field with a plurality of apertures formed therein and a net mounted within each aperture. A ball is provided having a circular configuration and formed of an elastomeric material. The ball has a pair of flexible resilient wings mounted on diametrically opposed sides thereof. A plurality of game units include a racquet and a lacrosse stick.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
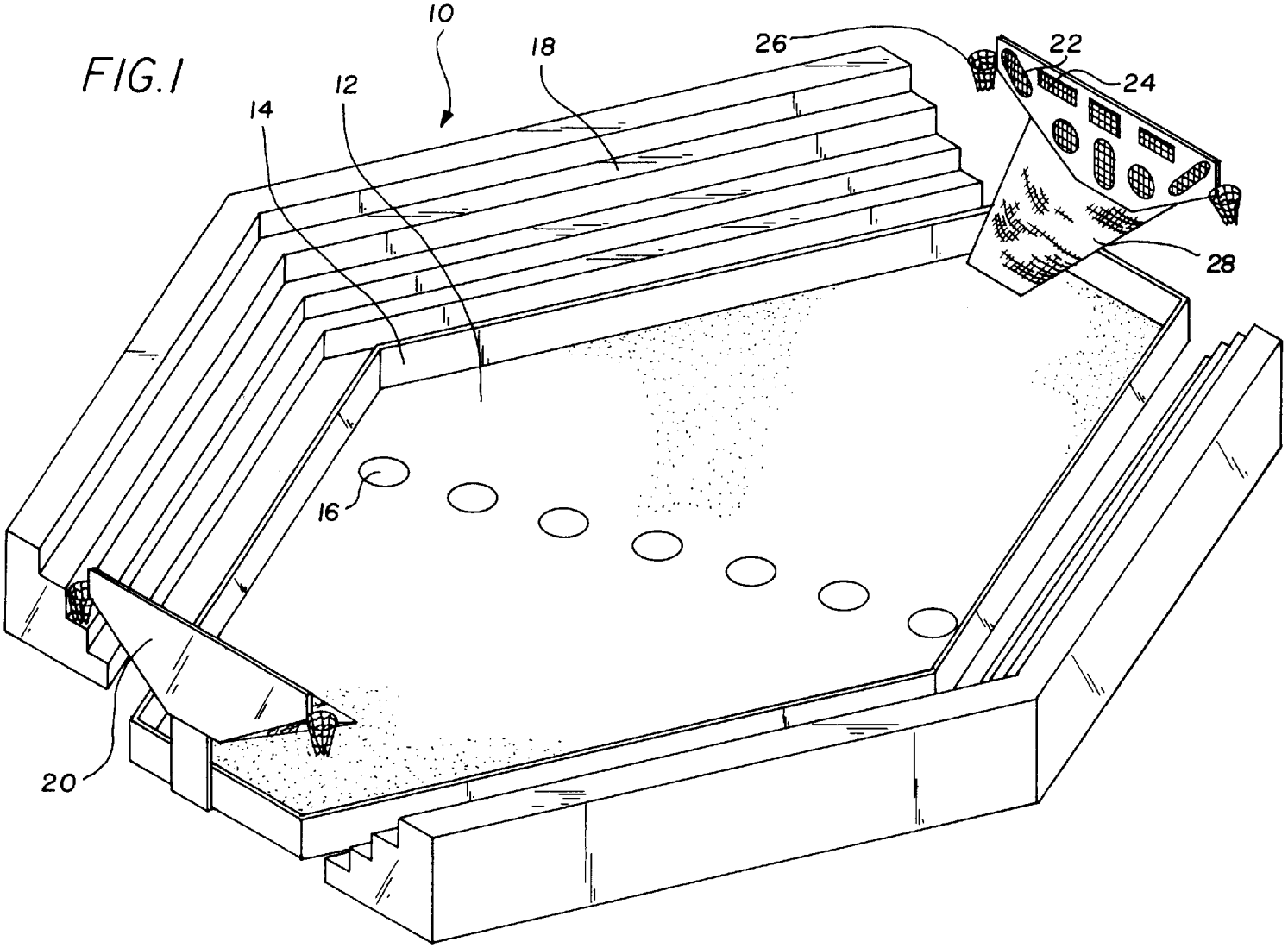
FIG. 1 is a perspective view of a new game according to the present invention.
Figure 2:
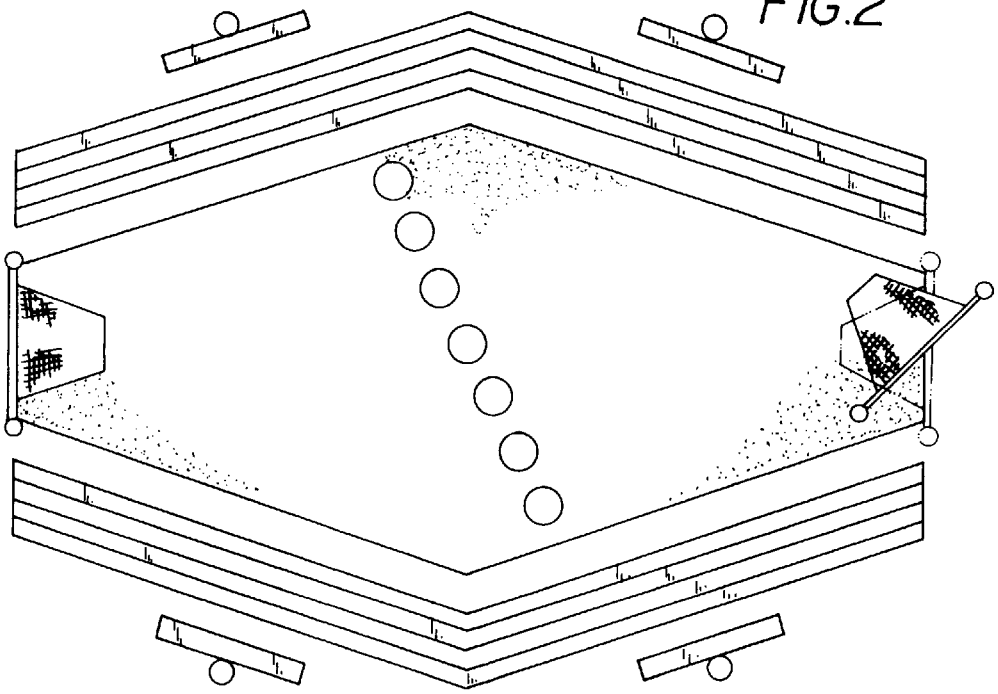
FIG. 2 is a top view of the playing field of the present invention.
Figure 3:
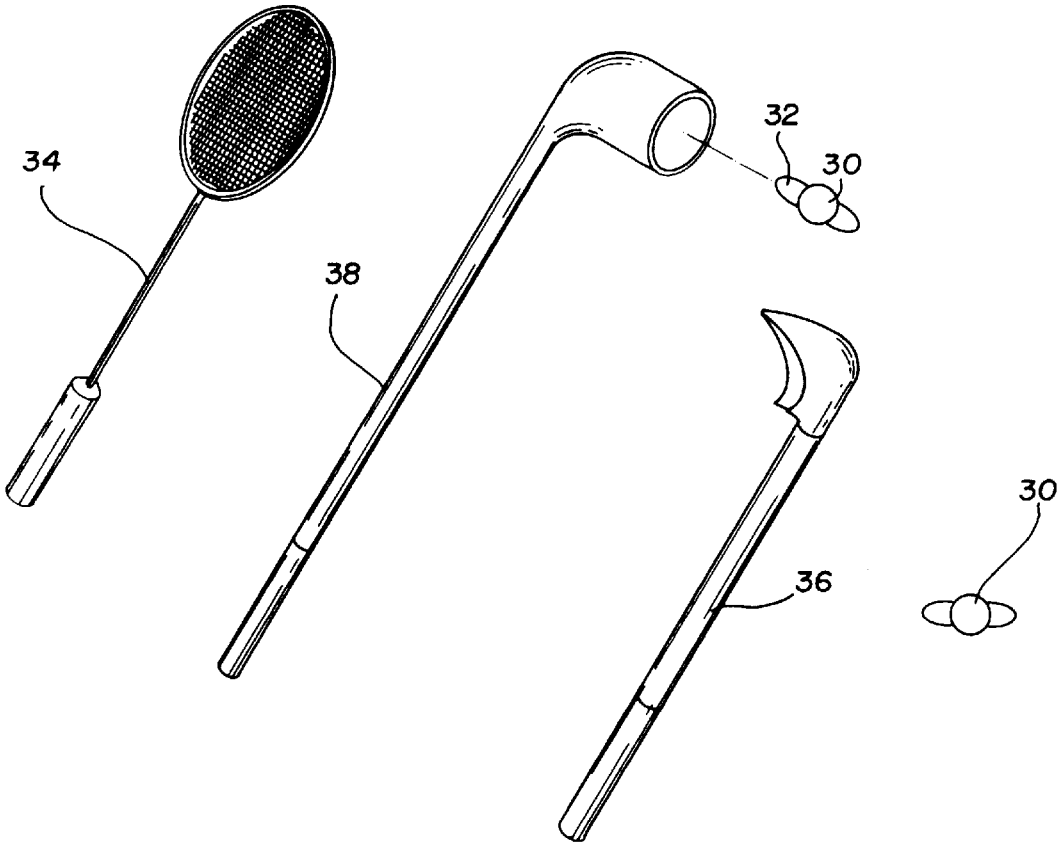
FIG. 3 is a perspective view of the present invention.

With reference now to the drawings, and in particular to FIGS. 1 through 3 thereof, a new game embodying the principles and concepts of the present invention and generally designated by the reference numeral 10 will be described.

The present invention, as designated as numeral 10, includes a playing field 12 having a generally diamond shaped configuration. As shown in FIG. 1, the game is equipped with a periphery defined by a peripheral vertical wall 14. For reasons that will soon become apparent, a plurality of circles 16 are situated on the playing field each with a unique playing indicia formed therein. It should be noted that the circles may be distributed about the playing field in any desired configuration.

Further provided is a pair of bleachers 18 each having a generally V-shaped configuration. The bleachers each line a corresponding side of the playing field.

FIG. 1 shows a pair of planar vertically oriented backboards 20 situated at opposite ends of the playing field and each having an inverted trapezoidal configuration. One of the backboards is colored white while the other is colored orange. A plurality of apertures 22 are formed in the backboard. Further, a net 24 is mounted within each aperture. Preferably, the netted apertures each have one of a plurality of shapes including a rectangle, square, circle and oval. A pair of baskets 26 are mounted on opposite sides of the backboard and extend outwardly therefrom. Lastly, a front net 28 is coupled to a bottom edge of the backboard and extends forwardly therefrom. It should be noted that the backboards are each adapted to pivot about a vertical axis.

A ball 30 is provided having a circular configuration. Such ball is formed of an elastomeric material. The ball has a pair of flexible resilient wings 32 mounted on diametrically opposite sides thereof. One wing is orange while the other is white.

Finally, a plurality of game units include a racquet 34, a lacrosse stick 36 and a thrower 38. As shown in FIG. 3, the thrower has an elongated handle and a cylindrical tube mounted to an end of the handle in perpendicular relationship therewith. The thrower is adapted for allowing a user to place the ball within the tube such that the same may be thrown. Various other games units such as a golf club, bat and the like may be included at the discretion of the users.

The method of play associated with the present invention will now be set forth. First, two teams of seven players are designated each having either white or orange uniforms. A referee is provided to monitor play. A team is then picked to play first by a guessing game wherein the ball is covered with a cloth by the referee and each teach guesses where one of the wings is directed.

The first team begins by using a game unit of choice to propel the ball into one of the apertures formed in the backboard and the basket. Each aperture and basket has point indicia printed adjacent thereto. Such point indicia is representative of a unique number of points which are awarded if the player successfully plants the ball within the net of the corresponding aperture or basket. It should be noted that during play, the orange team directs the ball toward the white backboard and visa-versa. During each turn, a game unit is used that corresponds to the indicia of a circle in which the ball lands after bouncing off the backboard during a previous player's turn. If the ball fails to land in a circle, the same game unit is used.

During normal play, the players of each team take a turn until each player has played at which time the players of the other team take turns playing. If, however, the ball should land in a circle with foul indicia indicated therein, play switches to the opposite team. Another way of switching teams would be to miss the apertures and the basket such that the ball bounces and lands such that the wing which has a color similar to the currently playing team is directed away from the backboard of the other color.

While not shown, a pair of unillustrated bee-shaped backboards are mounted behind the baskets. If a player should strike the bee-shaped backboard with the ball failing to go into the basket, 5 points are awarded. If, on the other hand, the ball enters the basket, 50 points are awarded. Upon a player directing the ball into the basket, his or her game unit is placed in front of one of the backboards and the player attempts to roll, or bowl, the ball toward the game unit. Another 50 points are awarded if the ball hits the game unit. Awarded points may further be augmented by pivoting of the targeted backboard board a predetermined amount to make directing the ball within the netted apertures a more difficult task. The winning team is designated as that who has the most points after four quarters.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An apparatus for playing a game comprising, in combination:

means delineating a playing area having opposed sides and opposed ends having a generally diamond shaped configuration with a periphery defined by a vertical wall and a plurality of circles situated within the playing area each with a unique;

a pair of bleachers each having a generally V-shaped configuration and extending along adjacent opposite portions of said was, said wall being positioned between said bleaches and the playing area;

a pair of planar vertically oriented backboards situated at opposite ends of the playing area and each having a plurality of apertures formed therein, a net mounted around the periphery of each aperture, a pair of baskets mounted on opposite sides of the backboard, and a front net coupled to a bottom edge of the backboard and extending forwardly therefrom, whereby the backboards are each adapted to pivot about a vertical axis;

a ball formed of an elastomeric material, the ball having a pair of flexible resilient wings mounted on diametrically opposite sides thereof; and a plurality of game units including a racquet, a lacrosse stick and a thrower, said thrower having an elongated handle and a cylindrical tube mounted to an end of the handle in perpendicular relationship therewith for allowing a user to place the ball within the tube such that the same may be thrown.

2. An apparatus for playing a game comprising:

means delineating a playing area having opposed sides and opposed ends;

a pair of planar vertically oriented backboards situated at opposite ends of the playing area and a plurality of apertures formed therein and a net mounted within around the periphery of each aperture;

a ball formed of an elastomeric material, the ball having a pair of flexible resilient wings mounted on diametrically opposite sides thereof; and a plurality of game units including a racquet and a lacrosse stick for use by a player to engage said ball.

3. An apparatus for playing a game as set forth in claim 2 wherein the game units further include a thrower having an elongated handle and a cylindrical tube mounted to an end of the handle in perpendicular relationship therewith for allowing a user to place the ball within the tube such that the same may be thrown.

4. An apparatus for playing a game as set forth in claim 2 wherein a front net is coupled to a bottom edge of the backboard and extended forwardly therefrom.

5. An apparatus for playing a game as set forth in claim 2 wherein the playing field has a generally diamond shaped configuration with a periphery defined by a peripheral vertical wall.

6. An apparatus for playing a game as set forth in claim 2 wherein the playing field has a plurality of circles situated on the playing field.

7. An apparatus for playing a game as set forth in claim 2 wherein a pair of bleachers are provided, each having a generally V-shaped configuration and positioned on corresponding opposite side of the playing area.

8. An apparatus for playing a game as set forth in claim 2 wherein a pair of baskets are mounted on opposite sides of the backboard.

9. A method of playing a game comprising the steps of:

providing a playing area having a generally diamond shaped configuration having opposite sides and opposite ends with a periphery defined by a vertical wall and a plurality of circles situated on the playing field.

providing a pair of bleachers each having a generally V-shaped configuration and positioned on corresponding opposite sides of the playing area;

providing a pair of planar vertically oriented backboards situated at opposite ends of the playing field and each having a plurality of apertures formed therein, a net mounted around the periphery of each aperture, a pair of baskets mounted on opposite sides of the backboard, and a front net coupled to a bottom edge of the backboard and extending forwardly therefrom;

providing a ball formed of an elastomeric material, the ball having a pair of flexible resilient wings mounted on diametrically opposite sides thereof;

providing including a racquet, a lacrosse stick and a thrower, said thrower having an elongated handle and a cylindrical tube mounted to an end of the handle in perpendicular relationship therewith for allowing a user to place the ball within the tube such that the same may be thrown;

designating two teams each with seven players;

determining which team plays first; and taking turns attempting to direct a ball into one of the apertures formed in the backboard and the basket using the game units.

* * * * *